US005832888A

United States Patent [19]

Griffiths et al.

[11] Patent Number: 5,832,888

[45] Date of Patent: Nov. 10, 1998

[54] THERMOSTATIC OVERRIDE SWITCH FOR AN AUTOMATIC CHOKE IN AN INTERNAL COMBUSTION ENGINE

[75] Inventors: John M. Griffiths, Fond du Lac; Keith W. Gessner, Kewaskum; George E. Phillips, Oshkosh, all of Wis.

[73] Assignee: Brunswick Corporation, Lake Forest, Ill.

[21] Appl. No.: 780,479

[22] Filed: Jan. 7, 1997

[51] Int. Cl.[6] ..... F02M 1/10

[52] U.S. Cl. ..... 123/179.18; 440/85

[58] Field of Search ..... 123/179.18, 179.16, 123/438, 439; 440/85

[56] References Cited

U.S. PATENT DOCUMENTS

| | | | |
|---|---|---|---|
| 2,969,785 | 1/1961 | Fuchs et al. | 123/179.16 |
| 3,783,301 | 1/1974 | Nieukirk | 290/38 R |
| 4,064,823 | 12/1977 | Draxler | 440/85 |
| 4,285,308 | 8/1981 | Hundertmark et al. | 123/187.5 R |
| 4,349,000 | 9/1982 | Staerzl | 123/491 |
| 4,429,673 | 2/1984 | Staerzl | 123/491 |
| 4,509,472 | 4/1985 | Slattery | 123/179 G |
| 4,532,903 | 8/1985 | Staerzl | 123/436 |
| 4,691,680 | 9/1987 | Staerzl | 123/491 |
| 4,836,506 | 6/1989 | Hundertmark | 261/23.2 |

OTHER PUBLICATIONS

Mariner Outboards Service Manual 90–828631, 895, 2D–1, Brunswick Corporation, 1995, admitted prior art.

*Primary Examiner*—Andrew M. Dolinar

*Attorney, Agent, or Firm*—Andrus, Sceales, Starke & Sawall

[57] ABSTRACT

An electrically powered automatic choke system for a turnkey outboard motor has a thermostatic override switch. The automatic choke feature is often not necessary, and sometimes not even desirable, when restarting the engine. The thermostatic override switch prevents the automatic choke from closing carburetor choke shutters when the ambient temperature near the engine under the cowl exceeds a choke deactivation temperature. A switch assembly is provided to retrofit engines on existing outboard motors.

2 Claims, 4 Drawing Sheets

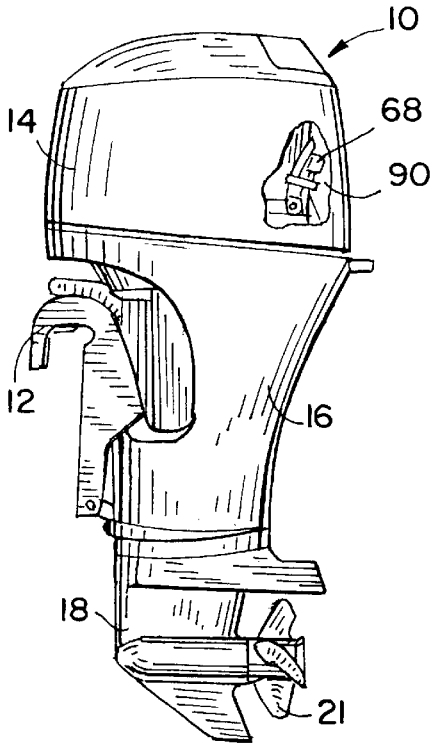
FIG. 1
FIG. 3
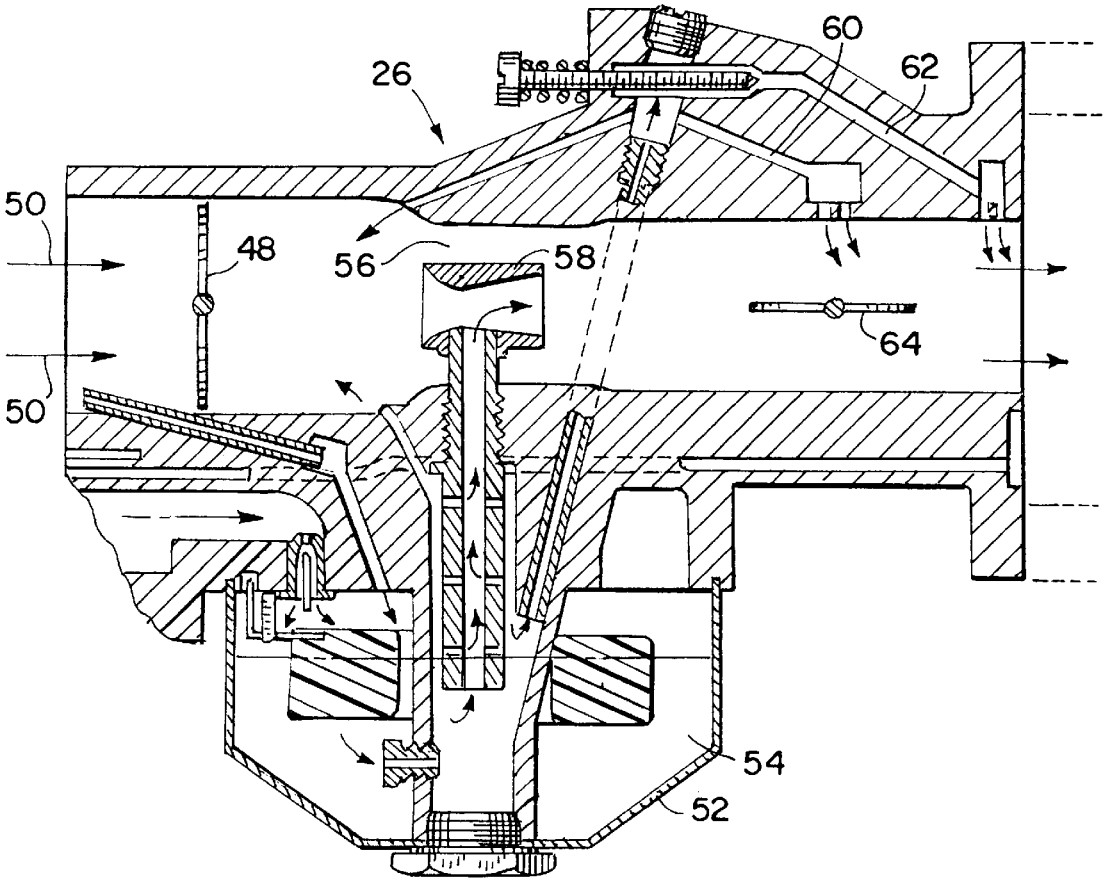

THERMOSTATIC OVERRIDE SWITCH FOR AN AUTOMATIC CHOKE IN AN INTERNAL COMBUSTION ENGINE

FIELD OF THE INVENTION

The invention relates to turnkey start outboard motors having carburetors and automatic choke mechanisms to facilitate starting when the engine is cold. More specifically, the invention relates to a thermostatic mechanism for overriding the automatic choke when the engine is warm or hot.

BACKGROUND OF THE INVENTION

In outboard motors having a turnkey start, an automatic choke actuator, such as a solenoid actuator, actuates to automatically close the choke shutter when the starter motor is activated. Closing the choke shutter enriches the fuel/air mix and facilitates the starting of a cold engine. However, it has been found that it is not always necessary to provide an automatic choke when restarting a warm or hot engine. When restarting some engines under some conditions, the automatic choke can adversely affect starting performance.

BRIEF SUMMARY OF THE INVENTION

The invention is a thermostatic override switch that prevents the automatic choke actuator from closing the carburetor choke during engine start-up when the ambient temperature under the cowl which houses the engine exceeds a choke deactivation temperature. The thermostatic switch can be used to retrofit an existing outboard, and solve existing problems that may have been experienced by an operator upon restarting the engine.

More specifically, the preferred thermostatic switch is a bimetallic strip switch that is mounted within the engine compartment defined by the top cowl for the outboard motor. The bimetallic switch opens when the ambient temperature under the cowl exceeds the choke deactivation temperature. Upon opening, the bimetallic switch prevents electrical current from flowing to power the automatic choke actuator. The preferred automatic choke actuator is an electric solenoid actuator that is linked mechanically to the carburetor choke shutters for each of the engine cylinders. It is typical that the automatic choke actuator maintain the choke shutters in a full-open position unless power is provided to the choke solenoid. Thus, by providing a bimetallic strip switch that opens when the ambient temperature under the cowl exceeds the choke deactivation temperature and preventing power to the choke solenoid under such conditions, the choke shutters are maintained in a full-open position even during engine start-up when the under cowl temperature exceeds the choke deactivation temperature.

BRIEF DESCRIPTION OF THE DRAWINGS

FIG. 1 is a side elevational view of an outboard motor illustrating use of the invention.

FIG. 3 is a schematic view illustrating the operation of an automatic choke.

DETAILED DESCRIPTION OF THE DRAWINGS

Figure 2:
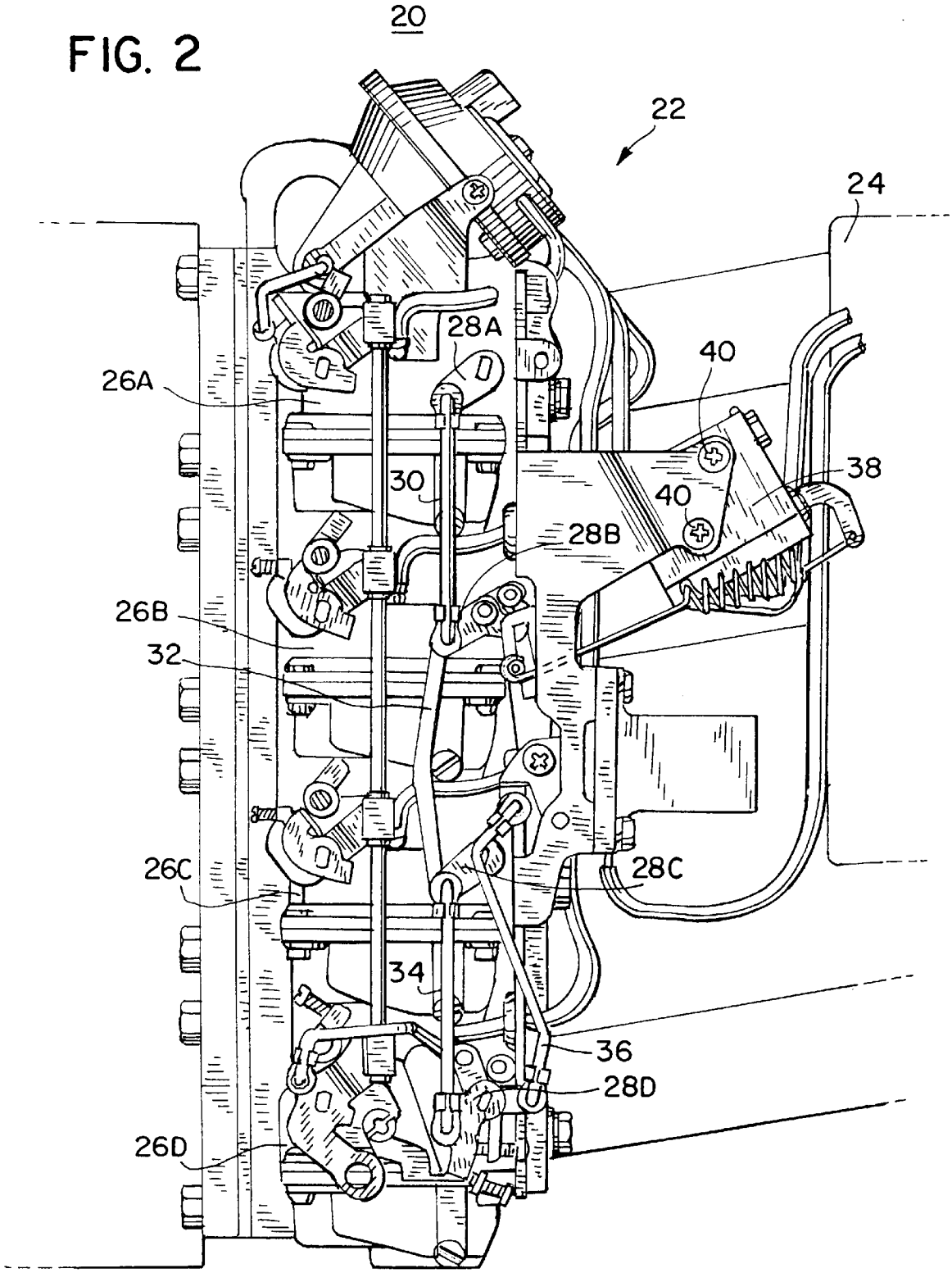
FIG. 2 is a side elevational view of an engine having an automatic choke actuator in accordance with the invention.

FIG. 1 illustrates an outboard motor 10. The outboard motor 10 has a transom swivel bracket 12 to mount the outboard motor 10 to the transom of a boat. The outboard motor 10 includes a top cowl 14, a bottom cowl 16, and a lower gear case 18. The top cowl 14 defines an engine compartment 20, FIG. 2, which contains an engine 22, FIG. 2. A drive shaft system connects the engine crankshaft to a clutch in the lower gear case 18. The clutch provides forward, neutral and reverse gears. The clutch in the lower gear case 18 drives a propeller shaft that is connected to the propeller 21.

Figure 6:
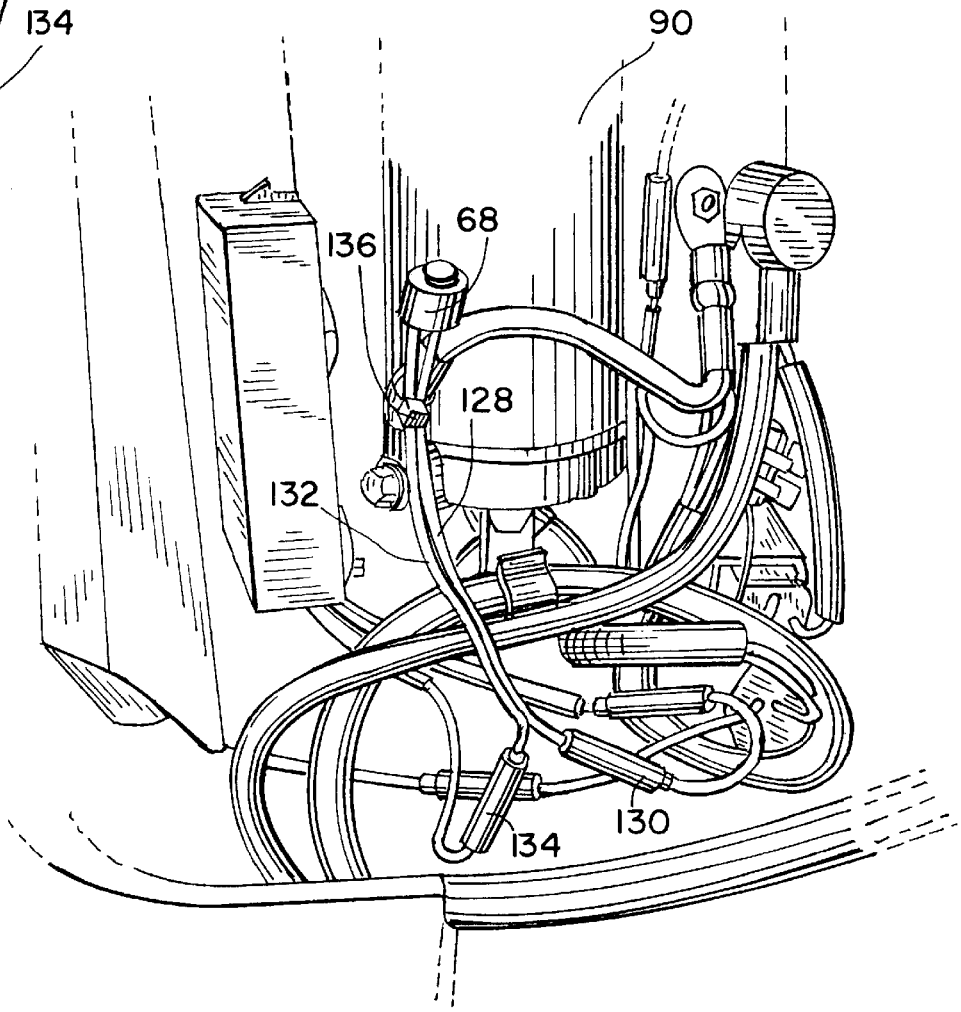
FIG. 6 is a view illustrating the thermostatic switch shown in FIG. 5 mounted on a starter motor for the outboard motor shown in FIG. 1.

Referring to FIG. 2, the engine 22 shown in FIGS. 2 and 6 is an example of an engine in which the invention is useful, however, the scope of the invention should not be limited thereto. The engine shown in FIG. 2 is a four-cylinder, four-stroke engine. The engine includes an air intake manifold 24 that provides intake air to each of four carburetors 26A, 26B, 26C, 26D. Each carburetor 26A, 26B, 26C, 26D has a pivotable choke cam 28A, 28B, 28C, 28D. An upper choke link 30 is connected between choke cams 28A and 28B. A joint plate 32 is connected between choke cams 28B and 28C. A lower choke link 34 is connected between choke cams 28C and 28D. In addition, a second lower choke link 36 is connected between choke cams 28C and 28D.

An electrical solenoid actuator 38 is mounted to the engine with fasteners 40. The solenoid actuator 38 is connected to the pivotable choke cam 28B by linkage (not shown). When the solenoid actuator 38 activates to move the linkage, the linkage pivots the choke cam 28B and contemporaneously pivots choke cams 28C, 28D and 28A via the carburetor choke linkage 34, 32, and 30.

FIG. 3 is a schematic illustration of the operation of one of the carburetors 26A, 26B, 26C, or 26D when the solenoid actuator 38 has been activated to close the carburetor choke shutter 48. In FIG. 3, intake air flows into the carburetor past the choke shutter 48 as illustrated by arrow 50. However, when the choke shutter 48 is closed or partially closed, intake air flow 50 through the carburetor is diminished, thus creating a slight vacuum within the carburetor 26. The carburetor includes a float bowl 52 that contains fuel 54. The slight vacuum with the carburetor passage 56 draws fuel through the primary venturi 58, and through the idle discharge ports 60 and 62, into the carburetor passage 56. With the choke shutter 48 fully or partially closed, the fuel/air mixture in the carburetor passage 56 is enriched which facilitates the starting of a cold engine. The throttle shutter 64 remains in an open position while starting the engine 22.

Figure 4:
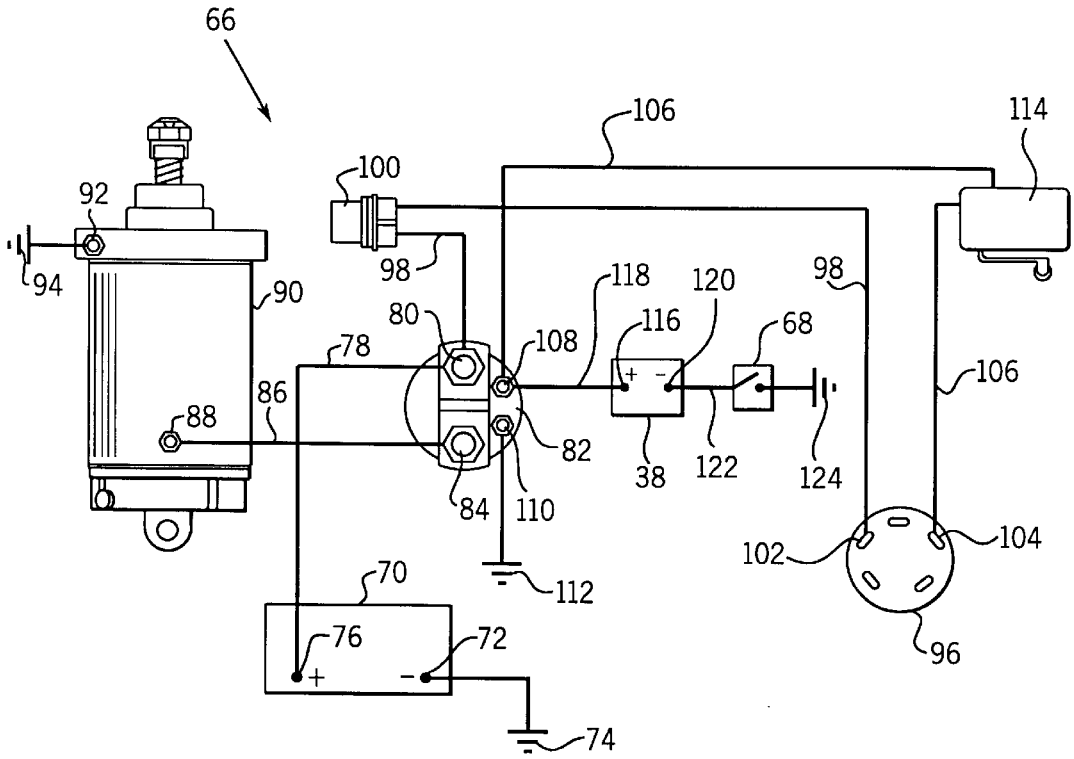
FIG. 4 is a schematic view illustrating an electrical circuit in accordance with the invention.

FIG. 4 illustrates an electrical starting system incorporating a thermostatic switch in accordance with the invention. The function of the starting system 66 is to crank the engine 22. The starting system 66 includes a 12-volt DC battery 70. The battery 70 has a negative terminal 72 connected electrically to ground 74. The battery 70 has a positive terminal 76 that is connected electrically via line 78 to a first contact 80 on a starter relay 82. When the starter relay 82 closes, the first contact 80 is electrically connected to a second contact 84 on the starter relay 82. The second contact 84 of the starter relay 82 is electrically connected via line 86 to a positive terminal 88 on starter motor 90. The starter motor 90 has a negative terminal 92 that is connected to ground 94. Thus, when the starter relay 82 is closed, 12-volt electrical DC power is supplied from the positive terminal 76 of the battery 70 to the starter motor 90.

The first contact 80 of the starter relay 82 is electrically connected to an ignition key start switch 96 via line 98. A fuse 100, preferably a 20 amp fuse, is located in line 98 between the first contact 80 of the starter relay 82 and the ignition key start switch 96. The ignition key start switch has an OFF position, an ON position, and a START position. When the ignition key start switch 96 is in the START position, the switch 96 provides an electrical connection between input terminal 102 and output terminal 104. Thus, when electrical DC power is provided in line 98 and the ignition key start switch 96 is in the START position, electrical DC power is provided in line 106. The invention is not limited to the use of an ignition key start switch having an ON position, an OFF position, and a START position. For instance, a push-button START switch or the like can be used, and should be considered to fall within the scope of the invention.

Line 106 connects electrically to a positive terminal 108 on the starter relay 82. A negative terminal 110 on the starter relay 82 is connected to ground 112. A neutral start switch 114 is located in line 106. The neutral start switch 114 is open unless the outboard is shifted into the neutral gear. If power is present in line 106 and the neutral start switch 114 is closed, power is provided to the starter relay 82, thus closing the starter relay 82 so that power is provided to the starter motor 90.

In addition, a positive terminal 116 for the automatic choke solenoid actuator 38 is electrically connected to the positive terminal 108 of the starter relay 82 via line 118. The negative terminal 120 of the automatic choke solenoid actuator 38 is connected to the thermostatic switch 68 via line 122. The thermostatic switch 68 is connected to ground 124. Thus, when electrical DC power is available at the positive terminal 108 of the starter relay 82, electrical power is provided to the automatic choke solenoid actuator 38 if thermostatic switch 68 is closed to provide electrical connection to ground 124. On the other hand, if the thermostatic switch 68 is open, the automatic choke actuator 38 does not receive power, and does not move the carburetor choke linkage to close the carburetor shutters 48.

Figure 5:
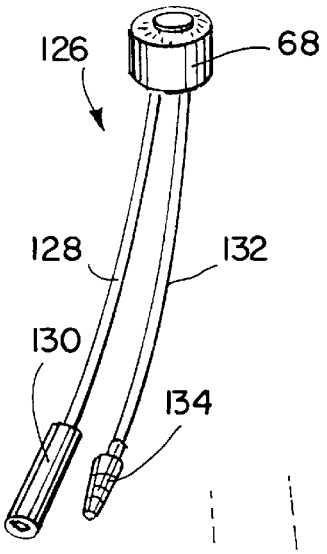
FIG. 5 is a detail view showing a thermostatic switch in accordance with the invention.

Referring to FIG. 5, the thermostatic switch 68 is preferably a bimetallic strip switch, such as Philips Technologies part number 053ZCZ11OR-0246. In the example shown in the drawings, the bimetallic strip switch 68 opens when under cowl temperatures reach 110° F. In order to facilitate the installation of the thermostatic switch 68 in an existing engine having an automatic choke, it is preferred that the switch 68 be part of a switch assembly 126 including the switch 68, a first lead wire 128 connected to a female adapter 130 and a second lead wire 132 connected to a male adapter 134.

Referring to FIG. 6, it is preferred that the switch assembly be mounted to the starter motor 90 or close thereto using a conventional wire harness 136. Such a mounting location for the thermostatic switch 68 is convenient, yet appropriately monitors the ambient temperature under the cowl in which the engine is located.

The invention as shown in the drawings is the preferred embodiment of the invention. However, the scope of the claims should not be limited to the embodiment of the invention shown in the drawings. For instance, while the drawings show the use of a bimetallic thermostatic switch, the invention covers other methods of sensing the ambient temperature under the cowl in which the engine resides and thereafter preventing the automatic choke actuator from closing the carburetor choke shutters when the sensed temperature exceeds a choke deactivation temperature. One such alternative would be providing a temperature sensor such as a thermal couple, or an RTD, within the engine compartment under the cowl to provide temperature signals to an electronic control unit that controls the operation of the automatic choke solenoid actuator.

Various other alternatives, modifications, and equivalents may be apparent to those skilled in the art. Such alternatives, modifications, and equivalents should be considered to come within the scope of the following claims.

I claim:

1. An outboard motor comprising:

a start switch having a start position;

an electric starter motor;

a battery that normally provides electrical power to the starter motor when the start switch is in the start position;

an engine including a carburetor having a choke shutter;

an automatic choke actuator that normally closes the carburetor choke shutter when the start switch is in the start position;

a cowl for the outboard motor covering the engine; and a thermostatic switch that prevents the automatic choke actuator from closing the carburetor choke shutter when the ambient temperature under the cowl exceeds a choke deactivation temperature, wherein the thermostatic switch is mounted to the starter motor.

2. An outboard motor comprising:

a start switch having a start position;

an electric starter motor;

a battery that normally provides electrical power to the starter motor when the start switch is in the start position;

an engine including a carburetor having a choke shutter;

an automatic choke actuator that normally closes the carburetor choke shutter when the start switch is in the start position;

a cowl for the outboard motor covering the engine; and a thermostatic switch that prevents the automatic choke actuator from closing the carburetor choke shutter when the ambient temperature under the cowl exceeds a choke deactivation temperature, wherein the automatic choke actuator is an electrically DC powered solenoid actuator having a positive terminal and a ground terminal and the thermostatic switch is connected electrically in-line between the ground terminal of the solenoid actuator and the electrical ground.

* * * * *